US007434900B2

(12) United States Patent
Slomianny et al.

(10) Patent No.: US 7,434,900 B2
(45) Date of Patent: Oct. 14, 2008

(54) INKJET PRINTER FOR PRINTING ON GOODS

(76) Inventors: Jan Slomianny, Am Sonnenhang 33 D-51588, Nümbrecht, Deutschland (DE); Andreas Slomianny, Am Sonnenhang 33 D-51588, Nümbrecht, Deutschland (DE)

( * ) Notice: Subject to any disclaimer, the term of this patent is extended or adjusted under 35 U.S.C. 154(b) by 169 days.

(21) Appl. No.: 11/178,726

(22) Filed: Jul. 11, 2005

(65) Prior Publication Data

US 2006/0012659 A1 Jan. 19, 2006

Related U.S. Application Data

(63) Continuation of application No. 09/646,790, filed as application No. PCT/DE99/00804 on Mar. 22, 1999, now abandoned.

(30) Foreign Application Priority Data

Mar. 21, 1998 (DE) ..... 198 12 480

(51) Int. Cl.
*B41J 2/195* (2006.01)

(52) U.S. Cl. ..... 347/7; 347/85

(58) Field of Classification Search ..... 347/7
See application file for complete search history.

(56) References Cited

U.S. PATENT DOCUMENTS 4,342,042 A * 7/1982 Cruz-Uribe et al. ..... 347/7
4,432,005 A * 2/1984 Duffield et al. ..... 347/86
4,769,650 A 9/1988 Peng et al.
4,792,817 A 12/1988 Barney
4,852,854 A 8/1989 Peng et al.
5,075,724 A 12/1991 Wada et al.
5,132,729 A 7/1992 Matsushita et al.
5,138,344 A 8/1992 Ujita
5,369,429 A 11/1994 Erickson
5,699,091 A 12/1997 Bullock et al.
5,788,388 A 8/1998 Cowger et al.
5,835,817 A 11/1998 Bullock et al.
6,019,461 A * 2/2000 Yoshimura et al. ..... 347/86
6,050,680 A * 4/2000 Moriyama et al. ..... 347/85

(Continued)

FOREIGN PATENT DOCUMENTS

DE 32 44 935 A1 6/1984

(Continued)

*Primary Examiner*—Matthew Luu
*Assistant Examiner*—Brian J Goldberg
(74) *Attorney, Agent, or Firm*—Akerman Senterfitt

(57) ABSTRACT

The present invention relates to an inkjet printer for printing on goods, wherein said printer comprises a computer for controlling the operation process, at least one replaceable tank in the shape of a bottle filled with a previously known quantity of a liquid, an intermediate container arranged in the printer and filled with the liquid from the tank as well as a device also arranged in the printer for detecting the quantity of liquid drawn from the tank. The invention is characterized in that the tank includes an identification element comprising a coded piece of information related to the liquid it contains. The identification elements is inputted into the computer when a new tank is mounted, while said computer comprises a verification program for checking the inputted identification element and for authorizing normal operation of the inkjet printer only when one at least selected verification criterion is correct, such as the use-by date.

6 Claims, 1 Drawing Sheet

U.S. PATENT DOCUMENTS 6,375,301 B1 * 4/2002 Childers et al. ..... 347/28

FOREIGN PATENT DOCUMENTS

EP 0 720 916 A2 7/1996
EP 0 789 322 A2 8/1997
WO WO 85/01104 A 3/1985
WO WO 98/04414 A 2/1998

* cited by examiner

INKJET PRINTER FOR PRINTING ON GOODS

BACKGROUND OF THE INVENTION

This application is a continuation of U.S. patent application Ser. No. 09/646,790, filed Sep. 21, 2000, which forms the national phase of PCT International Application No. PCT/DE99/00804 filed Sep. 30, 1999, which claimed the benefit of German Patent Application No. 19812480.5, filed Mar. 21, 1998.

FIELD OF THE INVENTION

The invention relates to an inkjet printer for printing on goods incorporating a computer controlling the operational process, at least one exchangeable reservoir bottle filled with a previously known quantity of a fluid, with a solvent or pigment for example, an installed intermediate container that is recharged with fluid from the reservoir bottle and an installed arrangement designed to detect the quantity of fluid drawn from the reservoir bottle as well as to the use of such a bottle-shaped reservoir in such type inkjet printer.

Inkjet printers printing on goods typically have a considerably higher fluid consumption like pigment fluid and solvent than inkjet printers printing on paper. On inkjet printers of the type mentioned above which are designed for printing on goods, the fluids needed for operation and printing, that is pigment and solvent in particular, are supplied from reservoirs that have a volume of one liter for example.

The reservoirs to be used are desired to be, if possible, commercial, reasonably priced standard bottles. Specially shaped containers which only fit specific inkjet printers however are expensive. But this financial aspect is still overcome by another aspect. It happens over and over again that a customer refills an already used, empty reservoir but that he does not use the therefor required fluid. It also happens that not entirely matching fluids from other manufacturers are offered in at least comparable reservoirs. Not to use the appropriate liquid, a wrong solvent for example, may lead in simple cases to a poor-quality printing result and in serious cases to failure of the inkjet printer. When complaints are made, in particular when warranty claims are asserted, it is not always easy for the manufacturer of the inkjet printer to find out whether a printer was operated with the correct or with wrong fluids.

SUMMARY OF THE INVENTION

Its object is to develop an inkjet printer of the type mentioned above so that although using the simplest possible, commercial reservoir bottles, the inkjet printer automatically checks whether a newly inserted reservoir bottle is filled with the correct fluid. A particular object of the invention is to prevent unwanted confusion between two reservoir bottles filled with distinct fluids due precisely to the use of simple bottles.

For the inkjet printer of the type mentioned above, the solution of this object is to provide the reservoir bottle with an externally visible label carrying coded information about the fluid it contains, e.g., an expiration date, the kind of fluid, the quantity of fluid, its viscosity and so on, to feed the label information into the computer when inserting a new reservoir bottle, to provide the computer with a test program that checks the inputted label information and that only allows normal operation of the inkjet printer when at least one selected test criterion, e.g., the expiration date, is acceptable and to have the output signal of the arrangement designed to detect the quantity of fluid drawn from the reservoir bottle on the computer and to deliver a signal "reservoir bottle empty" when the previously known quantity of fluid has been drawn from the reservoir bottle. The computer preferably has a memory in which the information from the label, such as the kind of fluid, the quantity of fluid, and its viscosity is stored, and this data is preferably deleted when a new reservoir bottle is inserted.

According to the invention, each reservoir bottle has an individual label. The label comprises coded information about the fluid it contains, about its expiration date in particular. Each reservoir bottle preferably has its own individual label, which cannot be found with any other reservoir bottle. The label comprises further indications about the fluid, such as the kind of fluid, the quantity of fluid, its viscosity, etc. The information present on the label is fed into the computer when a new reservoir bottle is inserted. The information may be entered by hand, for example, by having the label read and fed into a keyboard of the inkjet printer or mechanically by means of a scanner or even a scanning device located in the carriage supporting the reservoir in the inkjet printer.

The computer has a test program which is supplied with the information from the label. Said program checks the information on the label by comparing it with admissible label information. The label information may thereby be decoded or not. Normal operation of the inkjet printer is only set free when at least one selected test criterion, e.g., the expiration date, is acceptable. Additionally, a device designed to detect the quantity of fluid drawn from the reservoir bottle is provided, its output signal being applied to the computer, too. Once the previously known quantity of fluid has been drawn from a reservoir, a signal "reservoir bottle empty" is delivered. Subsequently, normal operation of the inkjet printer is stopped and is only set free again when a new label has been fed.

According to the invention, the inkjet printer only accepts a new reservoir bottle when the information of the label fed into the computer is appropriate. Thus, refill and reuse of an old, emptied reservoir bottle is made impossible. The inkjet printer only accepts proper reservoir bottles. It is thus made certain that the inkjet printer can only be operated with the fluids and can only process fluids for which it has been devised. This novel feature for example prevents a seal from being damaged, the printing results from worsening because of a wrong fluid, for example a wrong solvent, or even a dangerous operating state from occurring due to the use of an inflammable or explosive liquid for example.

Preferably, the label has the form of a seal and is fixed on the reservoir bottle at the spot that has to be damaged when inserting it into the inkjet printer, since this is the place where the reservoir bottle has to be opened. Thus, once the reservoir bottle is inserted, the information on the label is lost.

In a preferred development of the invention the signal "reservoir bottle empty" simultaneously suspends the tapping of fluid from the reservoir. A pump for example is stuck between reservoir bottle and intermediate container. Normal operation of the inkjet printer is only set free again after new coded label information has been input.

The reservoir bottle preferably has a volume that is considerably larger than the volume of the intermediate container. Preferably the volume of the bottle is six to ten times larger than the volume of the intermediate container, or may have a larger volume. In a preferred embodiment, the intermediate container has the function of detecting the quantity of fluid that has been drawn off the reservoir bottle. Thanks to the intermediate container, the reservoir bottle needs not be fitted with own means for detecting the instant quantity of fluid it contains, so that the reservoir bottle may have a very simple design.

In another embodiment the fluid drawn off the reservoir bottle is determined by counting the number of dots printed by the inkjet printer. A certain quantity of fluid is used per dot, this quantity may be determined by counting the printed dots.

The methods described are suitable for determining the pigment fluid particular. To detect the solvent, it is advantageous to simply record the operating time of the inkjet printer and to additionally take into consideration the temperature and possibly other parameters as well.

In a preferred development the signal "reservoir bottle empty" is delivered when the reservoir bottle is empty, the intermediate container however at least partially still full. This means that the inkjet printer can continue to run. Operation may be kept up for an adequate period of time during which the new reservoir bottle may be inserted.

To determine the expiration date, the computer preferably has a time unit that produces an internal date. This internal date is compared with the date indicated in the label. If the indications are not corresponding, the newly inserted reservoir bottle is not accepted and the inkjet printer does not resume normal operation. When the inkjet printer is not operating normally because of a wrong label, no label at all or the like, a corresponding indication is emitted and the message "wrong input" appears for example on the display of the inkjet printer. The wording of the corresponding message is such that a user can clearly distinguish between a malfunction of the inkjet printer due for example to the failure of a component part and the input of a wrong label.

In another preferred embodiment, the information on the label is machine readable, it has for example been given the form of a universal unit code. The advantage thereof is that the label needs not first be read and entered into the inkjet printer via the keyboard, but that the label information is entered mechanically, which is easier. In a particular development the label is read when a new reservoir bottle has been put on the right place in the inkjet printer.

Further advantages and characteristics of the invention will become clear in the claims and in the following description of embodiments that are only examples and are not limiting the scope of the invention, whereas said embodiments are explained in more detail with reference to the drawing.

DETAILED DESCRIPTION OF THE PREFERRED EMBODIMENTS

Figure 1:
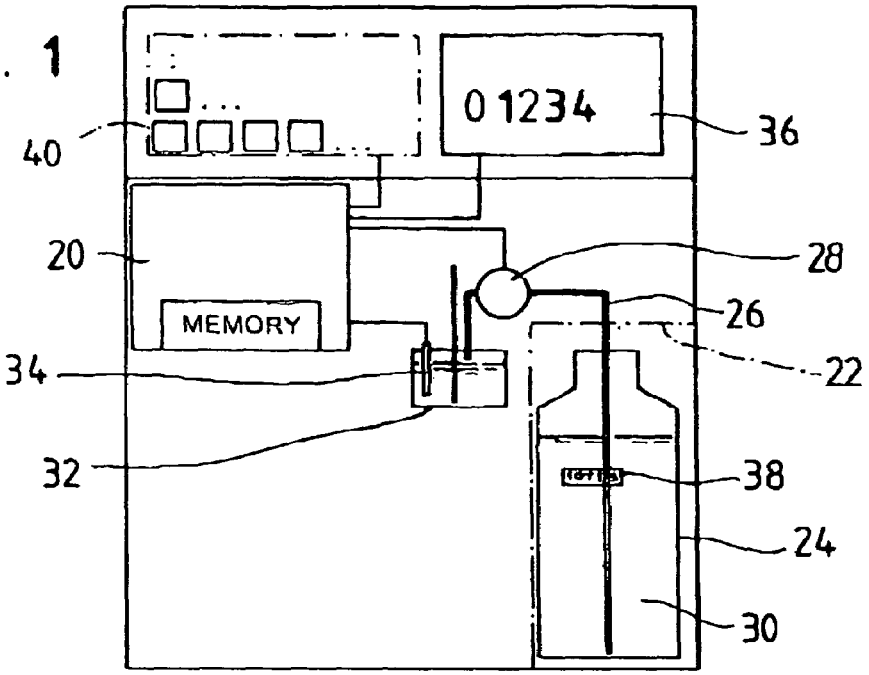
FIG. 1 is a schematic representation, substantially a front view of an inkjet printer printing on goods.

The ink-jet printer has a computer 20 controlling the internal operating sequences. Additionally it is provided with at least one reservoir bottle 24 accommodated in a holding device 22, said bottle containing a fluid, for example a pigment or a solvent. According to the invention, the reservoir bottle 24 used is of the simplest kind. It has neither windows for light barriers detecting the level nor any mechanical peculiarities nor an unusual stopper. The fluid 30 contained in the reservoir bottle 24 is drawn off by way of a suction pipe 26 incorporating a pump 28 and is conveyed to an installed intermediate container 32. In the embodiment according to FIG. 1, said intermediate container is equipped with an arrangement 34 designed to detect the quantity of fluid 30 that has been tapped from the reservoir bottle 24. To this purpose a sensor 34 is arranged in the intermediate container 32, it may be for example a capacitive sensor. Its output is connected to the computer. When the level of fluid 30 1 5 that has been detected between two level indicators has dropped inside the intermediate container 32, this fact is communicated to the computer 20 which records the corresponding data. If the intermediate container 32 has been emptied repeatedly and if the number of times it was emptied matches a predetermined quantity of fluid, the computer 20 delivers the signal "reservoir bottle empty". This signal appears for example on the display 36. It may also be delivered acoustically, by emitting a sound for example.

In the state described, the reservoir bottle 24 is empty, the intermediate container 32 is however still full enough to have the printing process kept up for a certain period of time. Now, the emptied reservoir bottle 24 can be replaced by a new, filled reservoir bottle 24. Said new bottle carries a label 38. Said label carries information for example numbers and letters. It is entered into the keyboard 40 of the ink-jet printer. The keyboard 40 is connected to the computer 20. An internal clock that generates an internal date is located in the computer. This date is compared with the date on the label 38. Other comparisons are made. The kind of liquid may for example be recorded in the computer. The information on the label contains this data, too. If, with regard to the kind of liquid, the piece of information read on the label matches the data recorded in the computer, the corresponding test criterion turns positive. If all selected test criteria are positive, normal operation of the ink-jet printer is set free.

When the signal "reservoir bottle empty" is delivered, the inkjet printer continues to run normally until the quantity of fluid contained in the intermediate container 32 is used up. Then, operation is stopped by blocking the pump 28 for example. Normal operation is only resumed when a proper label has been entered.

Figure 2:
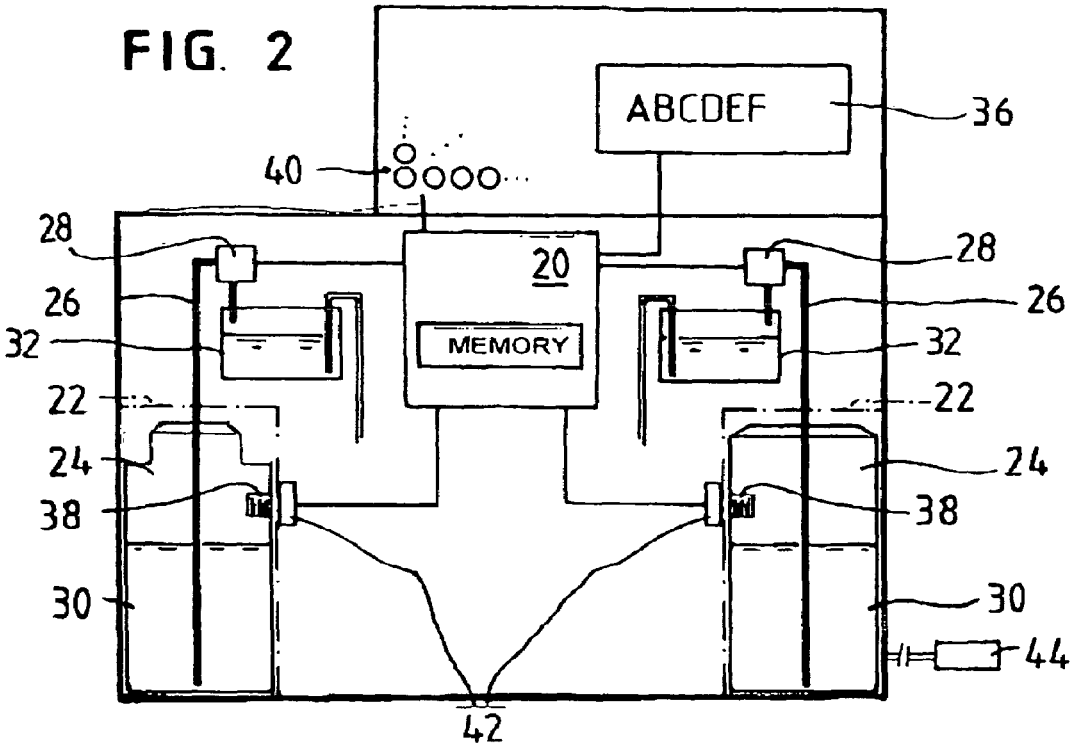
FIG. 2 is a representation similar to FIG. 1 of an inkjet printer, but in another embodiment.

In the embodiment according to FIG. 2 a scanning device 42 that is connected to the computer 20 is provided in the holding device 22. The scanning device 42 automatically scans a label 38 arranged on the reservoir bottle 24. In this case, it is no longer necessary to enter the information by hand.

The arrangement for registering the quantity of fluid drawn from the reservoir bottle is embodied in a different way as well. One possibility is to count the number of droplets ejected out of a printhead 44 and printed on a good that has not been illustrated in the drawings herein, the signal "reservoir bottle empty" being emitted upon reaching a certain number of droplets, 50 millions for example. Another possibility is to register and sum up the operating time as well as to determine at least the temperature while the inkjet printer is working. These data are used to know how much fluid, solvent for example, has gone lost during operation. The quantity of fluids that has to be employed anyway, for the printing process for example, is taken into consideration.

In the illustration according to FIG. 1, the label 38 can be a bar code as shown in the Figure, which is scanned by an optical scanning device 42. A chip 38 can also be utilized as a label, said chip carrying the relevant data. This chip permanently registers the necessary data, which means that it is not volatile. It may be permanently connected to the reservoir bottle 24. In case the reservoir bottle 24 is recharged, it is overwritten with new information. Additionally it is provided with a transmitting device having its counterpart in the scanning device 42, which is designed here as an appliance for data acquisition. The data can be transmitted in an electromagnetic, magnetic, capacitive or in any other way. In case of magnetic coupling, the chip 38 has a coil having a mating coil provided in the data acquisition appliance 42 assigned to it. Transmission of the information occurs by inductance. The inductance coupling can thereby also be used to transfer an alternating voltage from the appliance to the chip in order to feed the latter with electrical power.

Data transmission between the chip 38 and the data acquisition appliance 42 can only occur in one direction, that is from the chip 38 toward the data acquisition appliance 42, but it additionally can occur in reverse direction so that the chip is fed with information from the data acquisition appliance 42 which it registers.

FIG. 2 shows a printer with two exchangeable reservoir bottles 24. The two bottles 24 are filled with various fluids, for example solvent and pigment.

The computer 20 has a memory, see MEMORY in both figures, in which the information from the label 38 is stored. When an empty bottle is replaced by a new one, the information stored is deleted. The information of the label of the new bottle is fed into the computer, which is necessary to restart the printer.

The invention relates to the use of a reservoir bottle 24 in an inkjet printer, wherein the reservoir bottle 24 is filled with a fluid 30 required for the operation of the inkjet printer and is provided with a label 38 containing data needed by the computer 20 to operate the inkjet printer.

We claim:

1. An inkjet printer for printing on goods comprising:

a computer for controlling an operational process of the printer;

at least one exchangeable reservoir bottle filled initially with a previously known quantity of a fluid;

an intermediate container that is rechargeable with fluid from the reservoir bottle;

a suction pipe and a pump for recharging fluid from the reservoir bottle to the intermediate container;

a sensor arrangement for detecting the quantity of fluid drawn from the reservoir bottle to sense depletion of fluid in the reservoir bottles;

an externally visible label provided on the reservoir bottle which carries coded information about the fluid contained in the reservoir bottle;

means for feeding the label information into the computer when the reservoir bottle is inserted into the printer; and a test program provided in the computer that checks the label information and that only allows normal operation of the inkjet printer when at least one selected test criterion is acceptable;

wherein an output signal of the sensor arrangement for detecting the quantity of fluid drawn from the reservoir bottle is fed into the computer and the computer compares the quantity of fluid drawn from the reservoir bottle with the previously known quantity of fluid and emits a "reservoir bottle empty" signal when the previously known quantity of fluid has been drawn from the reservoir bottle indicating that the reservoir bottle is empty, the intermediate container being however at least partially still full such that operation of the printer can continue to run during a period of time sufficient to exchange a new reservoir bottle for the depleted reservoir bottle, and wherein the coded information is lost once the reservoir bottle is inserted into the inkjet printer, wherein at the same time as the computer emits the signal "reservoir bottle empty", the computer suspends the tapping of fluid from the reservoir bottle and only allows the tapping of fluid from a new reservoir bottle after information from a new coded label has been input, which new reservoir bottle is installed to replace the now empty reservoir bottle, wherein the volume of the reservoir bottle is more than six times the volume of the intermediate container, wherein the computer has a time unit that produces an internal date and this internal date is compared with the date indicated on the label, wherein the label information is one of the expiration date, the kind of fluid, the quantity of fluid and the viscosity of fluid, and wherein the computer is provided with a memory in which the information from the label is stored and wherein the information stored in the memory is deleted when a new reservoir bottle is inserted into the printer.

2. The inkjet printer according to claim 1, wherein the volume of the reservoir bottle is more than ten times the volume of the intermediate container.

3. The inkjet printer according to claim 1, wherein the computer is provided with a memory in which the information from the label is stored.

4. The inkjet printer according to claim 1, wherein the least one selected test criterion is the expiration date.

5. An inkjet printer for printing on goods comprising in combination:

a computer for controlling an operational process of the printer;

two exchangeable reservoir bottles, each reservnr bottle filled initially with a previously known quantity of a fluid, the fluids in the two bottles being different;

an intermediate container that is recharged with fluid from at least one of the reservoir bottles;

a suction pipe and a pump for recharging fluid from each one of the reservoir bottles to the intermediate container;

a sensor arrangement for detecting the quantity of fluid drawn from each one of the reservoir bottles to sense depletion of fluid in the reservoir bottles;

an externally visible label providedon each one of the reservoir bottles which carries coded information about the fluid contained in the respective reservoir bottle;

means for feeding the label information into the computer when the reservoir bottles are inserted into the printer; and a test program provided in the computer that checks the input label information and that only allows normal operation of the inkjet printer when at least one selected test criterion is acceptable;

wherein an output signal of the sensor arrangement is fed into the computer and the computer compares the quantity of fluid drawn from the reservoir bottle with the previously known quantity of fluid and emits a "reservoir bottle empty" signal when the previously known quantity of fluid has been drawn from one of the reservoir bottles indicating that the reservoir bottle is empty, the intermediate container being however at least partially still full such that operation of the printer can continue to run during a period of time sufficient to exchange a new reservoir bottle for the depleted reservoir bottle, and wherein the coded information is lost once the reservoir bottle is inserted into the inkjet printer, wherein at the same time as the computer emits the signal "reservoir bottle empty", the computer suspends the tapping of fluid from the reservoir bottle and only allows the tapping of fluid from a new reservoir bottle after information from a new coded label has been input, which new reservoir bottle is installed to replace the now empty reservoir bottle, wherein the volume of the reservoir bottle is more than six times the volume of the intermediate container, wherein the computer has a time unit that nroduces an internal date and this internal date is compared with the date indicated on the label, wherein the label information is one of the expiration date, the kind of fluid, the quantity of fluid and the viscosity of fluid, and wherein the computer is provided with a memory in which the information from the label is stored and wherein the information stored in the memory is deleted when a new reservoir bottle is inserted into the printer.

6. The inkjet printer according to claim 5, wherein one reservoir bottle is filled with a solvent and the other reservoir bottle is filled with pigment.

* * * * *